US008876249B2

(12) United States Patent
Perets et al.

(10) Patent No.: US 8,876,249 B2
(45) Date of Patent: Nov. 4, 2014

(54) PRINTING METHOD AND APPARATUS

(71) Applicant: Hewlett-Packard Industrial Printing Ltd., Netanya (IL)

(72) Inventors: Oren Perets, Netanya (IL); Yuval Eckstein, Netanya (IL); Dennis Indorsky, Netanya (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 21 days.

(21) Appl. No.: 13/857,748

(22) Filed: Apr. 5, 2013

(65) Prior Publication Data

US 2014/0300662 A1 Oct. 9, 2014

(51) Int. Cl.
*B41J 29/393* (2006.01)

(52) U.S. Cl.
CPC ..... *B41J 29/393* (2013.01)
USPC ..... 347/19

(58) Field of Classification Search
USPC ..... 347/9, 12, 14, 15, 19, 40, 43
See application file for complete search history.

(56) References Cited

U.S. PATENT DOCUMENTS

| | | | | |
|---|---|---|---|---|
| 6,283,572 | B1 | 9/2001 | Kumar et al. | |
| 6,659,580 | B2 | 12/2003 | Horikoshi | |
| 7,168,779 | B2 * | 1/2007 | Smith et al. | 347/19 |
| 7,387,361 | B1 * | 6/2008 | Rueby et al. | 347/40 |
| 7,775,614 | B2 * | 8/2010 | Takizawa et al. | 347/9 |
| 7,828,403 | B2 * | 11/2010 | Rueby | 347/12 |

* cited by examiner

*Primary Examiner* — Kristal Feggins

(57) ABSTRACT

An apparatus and method for use in printing an image in a multipass printing device, the method comprising obtaining information identifying two or more defective nozzles in a nozzle array, determining that a line of a printed image is associated with more than a first predetermined number of defective nozzles based on the obtained information identifying two or more defective nozzles and selected step sizes, and identifying adjusted step sizes such that no more than the first predetermined number of defective nozzles is associated with any line of the printed image.

16 Claims, 3 Drawing Sheets

PRINTING METHOD AND APPARATUS

BACKGROUND

Inkjet printers print dots on a print medium by ejecting small drops of ink from one or more nozzles. Commonly, a number of nozzles are carried on a moveable print head which can be scanned across a surface of the print medium. Each nozzle may be controlled individually to eject a drop of printing fluid, such as ink when commanded. By appropriate control of each nozzle as the print head carrying the nozzles is scanned across the surface of the print media, a desired pattern of printing fluid drops can be deposited on the print medium.

Inkjet printers use a predefined set of "printing modes" where all printing parameters are set by the manufacturer and are static (i.e. do not change with reaction to printer behaviors). Different printing modes may be provided for different types of content to be printed.

Print heads may carry an array of nozzles allowing ink to be deposited in a number of lines of pixels, or a swath, in a single pass of the print head. To allow a full image, consisting of a number of swathes to be deposited on the print medium, the medium is advanced through the printer to allow subsequent swathes to be deposited. Multiple colours of ink may be deposited using a separate nozzle array for each colour of ink, and by controlling the location at which different colour drops of ink according to a mask.

Often, inkjet printers print in a multi pass printing method, where the nozzle array is scanned across each region of the print medium a number of times with ink being deposited on more than one pass of the print head. This is usually done as the scanning array moves in the cross-print (lines) axis between each and every scan. After each pass of the print head the print medium is advanced through the printer by a proportion of the height of a swath such that ink deposited to the same line on the print medium will be delivered by a different nozzle in the nozzle array in a subsequent pass.

This creates a redundancy, where every image line printed has the opportunity to be printed by a different nozzle each time the nozzle array is scanned across the print medium. Fore print mode where an image is printed in "three pass", every line has three different nozzles that may take place in printing it.

To avoid a situation where a line is printed fully three times (in the above example), typically the line is separated for each nozzle using a mask.

BRIEF INTRODUCTION OF THE DRAWINGS

Figure 1A:
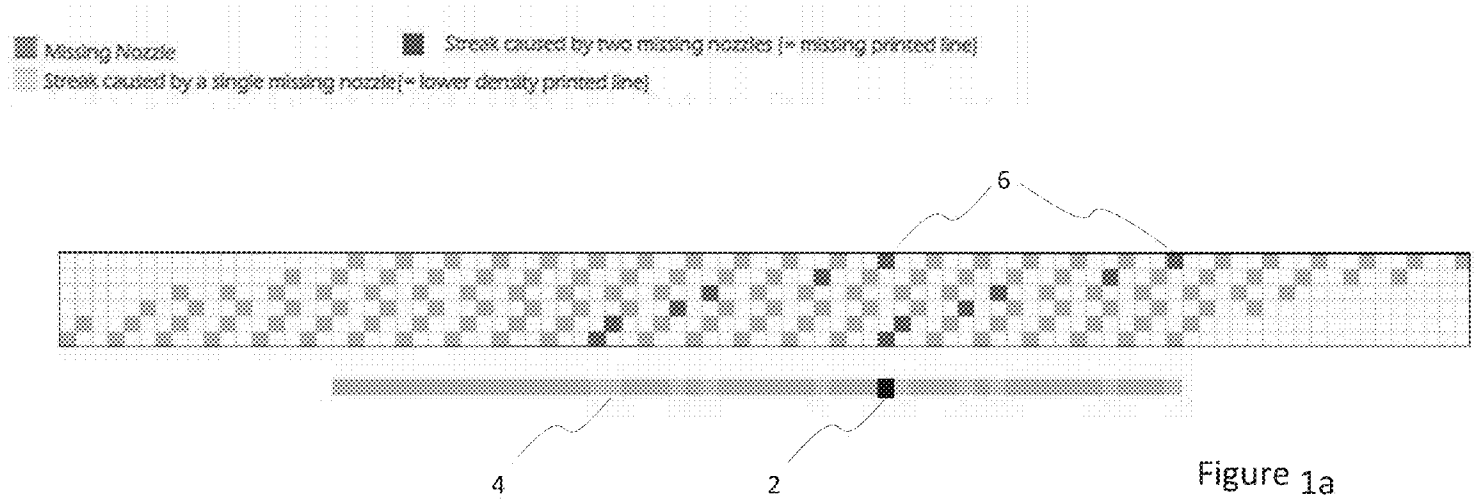
Figure 1B:
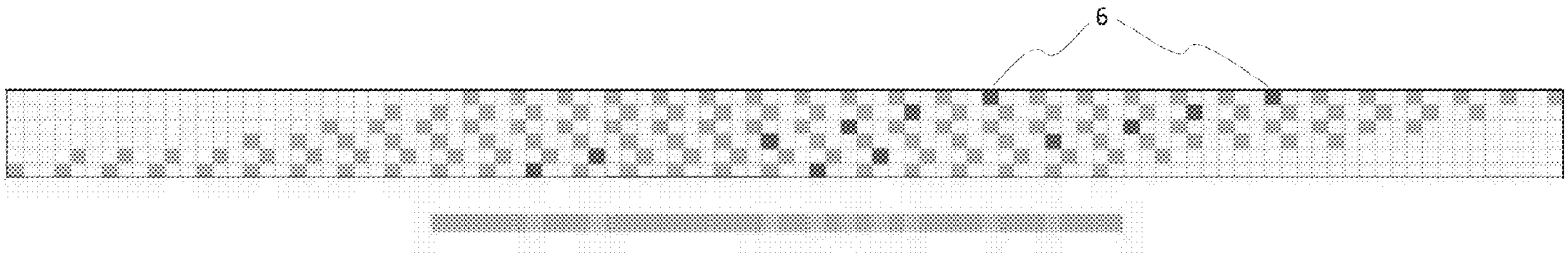
Figure 2:
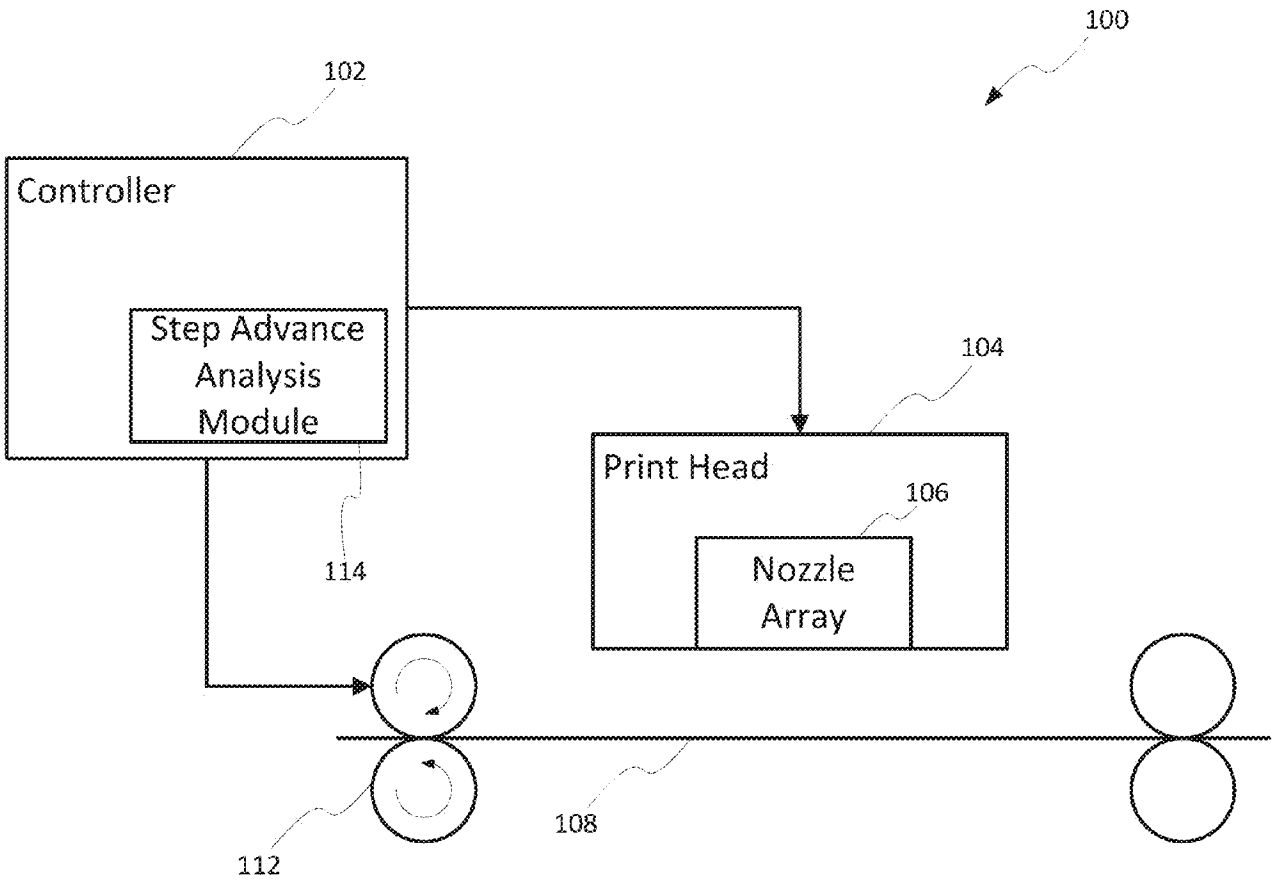
Figure 3:
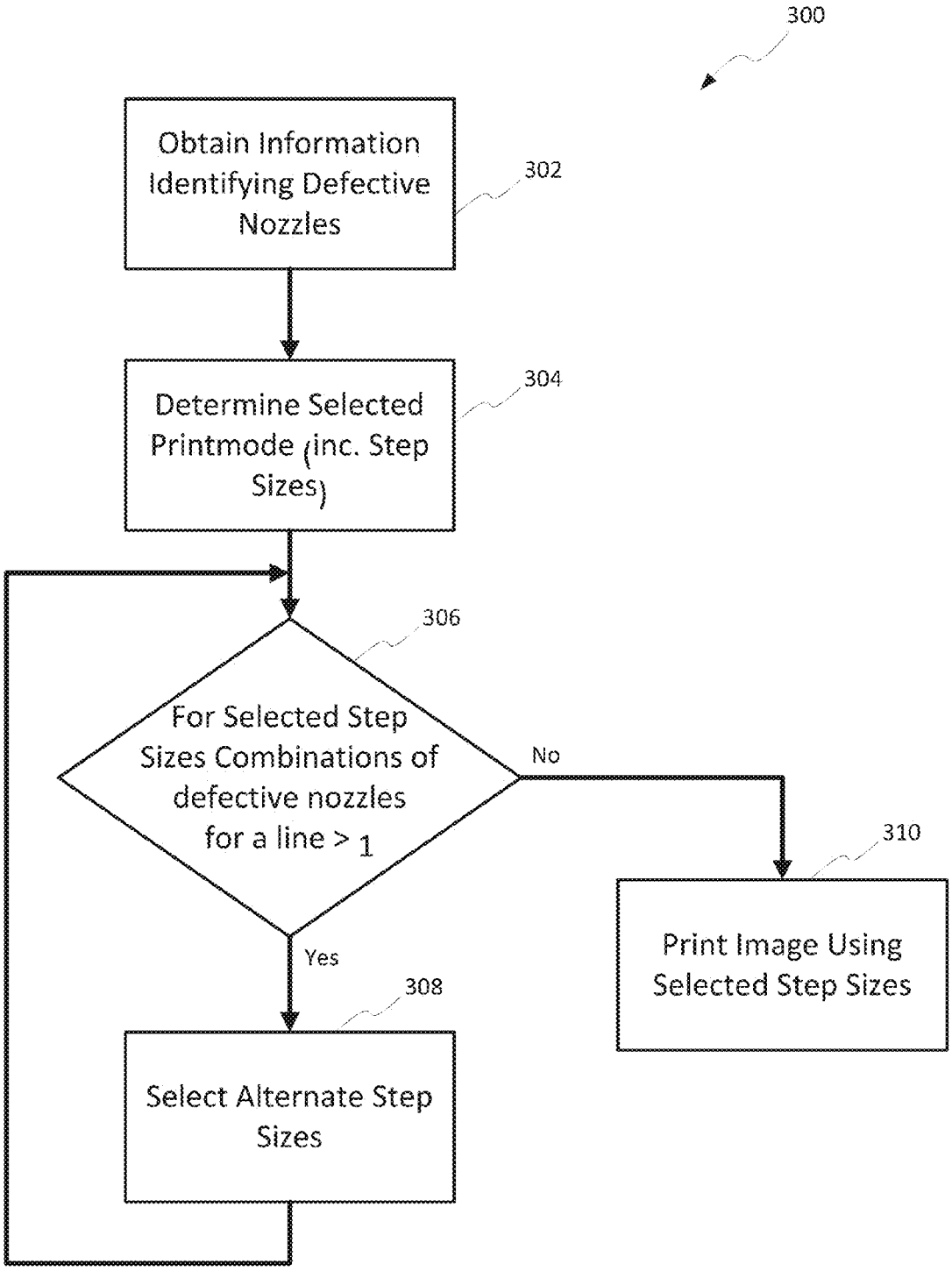

Embodiments of the present invention are further described hereinafter by way of example only with reference to the accompanying drawings, in which:

FIG. 1*a* illustrates the coincidental alignment of defective nozzles on separate passes of a print head;

FIG. 1*b* illustrates the output of the same nozzle array as used in FIG. 1*a* with adjusted step sizes;

FIG. 2 illustrates a block diagram of a printing system according to one example; and FIG. 3 illustrates a method of adjusting step sizes to avoid coincidental alignment of defective nozzles.

DETAILED DESCRIPTION OF AN EXAMPLE

On an inkjet printer where missing (or malfunctioning) nozzles exists within the array of nozzles, some lines in the final image deposited on a print medium will have less ink than desired as they will be printed with fewer nozzles than planned. For example, a single blocked nozzle within the array will result in one line of each swath printed in a single pass receiving no ink. In a multipass print mode, each line can be expected to be printed to by more than one nozzle (i.e. by a different nozzle for each pass) and therefore the effect of one blocked nozzle may be limited in the final image.

For example, for a three pass print mode, every line may be printed to by three different nozzles, and therefore one blocked nozzle may be expected to result in two thirds of the expected density of ink being deposited for that line.

However, blocked nozzles may lead to more significant printing artifacts under certain conditions. In particular, if multiple blocked nozzles exist within the nozzle array, it is possible that a first blocked nozzle may be intended to print a certain line of the final image during a first pass, and a second different blocked nozzle may be intended to print the same line of the final image during a subsequent pass after the print medium has been advanced through the printer.

As an example, for a nozzle array having ninety nozzles operating in a three pass print mode in which the print medium is advanced by a third of the height of the nozzle array between each pass of the print head. If the first, thirty first and sixty first nozzles of the array were to be blocked, a line that should be printed by the first nozzle in the first pass, would then be assigned to be printed by the thirty first nozzle in a second pass and the sixty first nozzle in a third pass. As all of these nozzles in this example are blocked, no ink is deposited for this line at all. Furthermore, this would be repeated, such that in each swath of the image, three lines would receive no ink. Such regular repeating patterns of print irregularities are particularly noticeable in the final image.

Similar problems may be experienced in respect of deviating or low drop weight nozzles (i.e. the nozzles that participate in reproducing a given image line are not of a uniform nature). The resulting disparities between the amounts of ink deposited for different lines of the image results in visible print artifacts and ultimately a lower print quality for the final image.

Some earlier attempts to address this problem have relied on identification of malfunctioning nozzles and then attempting to compensate for the malfunctioning nozzles by substituting working nozzles or increasing the amount of ink deposited by other nozzles (i.e. by moving the image data between participating nozzles through modification of the print mask).

While this approach deals with the combinations of missing/weak nozzles as they are derived from a given, fixed printmode, the combinations of nozzles for a given line/area is not controlled by the printer and the printer does not change the nozzle combinations used to print a specific line, rather this remains fixed according to the chosen multipass printmode. Thus, coincidental combinations of malfunctioning nozzles defined by a printmode will not be changed, and the above described scenario in which no ink is deposited for a line of the final image may still occur.

According to embodiments of the present invention the step size by which the print medium is advanced through the printer may be modified to mitigate the effect of blocked or malfunctioning nozzles on the final image.

For example, for a given set of missing or blocked nozzles in a nozzle array and a selected printmode, the printer application builds an analysis of which combinations of missing nozzles will be used to print each line in the image using the selected printmode. If the determined combinations include configurations in which more than one missing nozzle for a predetermined number of missing nozzles) are participating in reproducing a particular image line, the application will scan several other (or all) possible printmode step sizes and determine which combination(s) of printmode step sizes may be used to mitigate or eliminate the situation whereby more than a single missing nozzle is participating in reproducing an image line.

The described approach can be applied to nozzle malfunctions other than just blocked nozzles, for example if other attributes of nozzles are known (for instance, drop weight and/or cross print misdirectionalities), then these attributes can be taken into consideration while analyzing the nozzle combinations.

Thus, the printmode cross print step sizes (i.e. carriage/media step sizes) can be modified to mitigate or limit the number of missing or malfunctioning nozzles used to deposit ink on a line of the final image. After the printmode step sizes are changed, missing nozzles compensation algorithms, such as previously described, can be applied to the print mask to further improve the final image produced by the printer.

FIG. 1*a* schematically illustrates a number of lines of pixels of an image printed using a nozzle array including two blocked nozzles 6. The pixels have been printed using set step sizes associated with a printmode. In this case, it can be seen that due to the step sizes and the distance between the blocked nozzles 6 in the nozzle array, a first line 2 is present in the final image in which no ink has been deposited. Furthermore, a second line 4 comprises two adjacent lines each associated with a blocked nozzle. Thus, the configuration illustrated in FIG. 1*a* will result in a number of repeating printing artifacts across the scan direction of the page which will significantly reduce the quality of the printed image.

FIG. 1*b* schematically illustrates a number of lines of pixels printed using the same nozzle array, and having the same blocked nozzles 6. However, by modification of the step sizes between each pass of the print head, the output no longer includes any lines which received no ink droplets or any adjacent lines both associated with a defective nozzle. Thus, by modifying the step sizes as illustrated in FIG. 1*b*, the severity of the print artifacts caused by the blocked nozzles 6 can be reduced, and the overall print quality increased.

FIG. 2 illustrates a print apparatus that can be used to implement some embodiments of the invention. The print apparatus 100 comprises a controller 102 coupled to a print head assembly 104 and to a print media feed 112. The print head assembly 104 includes a plurality of nozzles 106 which can be individually controlled to eject a drop of ink upon command. The nozzles are arranged in an array to allow a swath a number of pixels high to be printed to in each pass of the print head 104 across the print medium 108. Print media feed 112 operates to advance a print medium 108 through the print apparatus 100 under control of the controller 102.

In operation, controller 102 receives an image to be printed and uses the image data to determine where droplets of ink should be deposited on the print medium to approximate the received image using the ink colors available from an ink supply. A print mask associated with a selected printmode will be used to determine which nozzles should be used in each pass of the print head to deposit the drops of ink in the desired locations.

Prior to printing an image, the controller may undertake certain diagnostic processes on the nozzle array 106 which allow the controller 102 to determine whether any nozzles are blocked and/or malfunctioning in a way that may impact image quality. The diagnostic processes may be applied at regular intervals or as part of a specific calibration process performed on the printer. The identities of malfunctioning nozzles are then stored for later use.

Based on the selected printmode and the identities of malfunctioning nozzles, a step advance analysis module 114 within the controller 102 analyses the combinations of nozzles that are to be used to print each line of the image on a print medium and determines whether the combinations will result in more than one defective nozzle participating in reproducing an image line. If such a combination is found, the Step Advance Analysis module 114 analyses the combinations produced by different printmode step sizes to identify a printmode step that eliminates the situation whereby more than one defective nozzle is used for any one line of the final image. If no available printmode step sizes allow the use of multiple defective nozzles for any one line to be avoided, the Step Advance Analysis module 114 may attempt to minimize such combinations to mitigate as far as possible print artifacts in the final image due to coincidental combinations of defective nozzles being used together.

Once this analysis has been completed by the Step Advance Analysis module 114, the image may be printed to the print medium using the selected step sizes for the printmode.

To print the image, the print head 104 is scanned across the print medium 108 under control of the controller 102 and individual nozzles of the nozzle array 106 are commanded to eject drops of ink at specific positions, according to the print mask. Once a swath has been printed, the print media feed 112 is commanded to advance the print medium 108 through the printing device 100 by the determined step size for that pass provided by the Step Advance Analysis module 114. By repeating this procedure, a desired image may be reproduced on the print medium 108.

In some examples, the threshold for changing the step sizes may be combinations of two, or some other predetermined number of, defective nozzles being used to print a line of the final image.

FIG. 3 illustrates an example method 300 of selecting printmode step sizes. In a first step 302, information identifying defective nozzles is obtained. For example, this information may be retrieved from storage or determined through diagnostics performed on the nozzle array. Next, the selected printmode is determined 304, including the step sizes associated with the selected printmode. A determination is then made in step 306 as to whether the step sizes result in a combination of multiple defective nozzles being used to print a line of the final image, based on the obtained information identifying the defective nozzles. If no combinations of multiple defective nozzles are identified, the method proceeds to step 310 in which the image is printed using the selected step sizes. However, if a combination of multiple defective nozzles are identified, alternative step sizes are selected in step 308 and then the method returns to step 306 to reanalyze the combinations of nozzles based on the newly selected step sizes.

In operation, a number of loops of steps 306 and 308 may be performed in which different step sizes are selected and reanalyzed until a satisfactory set of step sizes are identified. The image can then be printed using the final selected step sizes.

In some examples, the threshold in step 306 may be a number other than one. Alternatively, the threshold may be incremented if it is determined that no available step sizes allow an original threshold to be met.

According to further example implementations, the step sizes may be chosen in order to, not only avoid multiple defective nozzles being used on a single line, but also to avoid adjacent lines of the image being printed using a defective nozzles. In some examples, step sizes may be adjusted to avoid a number of lines with more than a predetermined number of defective nozzles being present at a regular frequency in the image. It is known that the human eye is particularly sensitive to certain spatial frequencies, for example a print in which missing lines are apparent at every tenth printed line would be particularly obvious, and would be considered to result in significantly reduced quality of the printed image. Thus, example implementations can adjust step sizes based on the analysis of combinations of defective nozzles to avoid print artifacts that appear at such spatial frequencies.

According to yet further example implementations, the step sizes may be adjusted to avoid a large number of missing lines (or lines printed with more than a certain number of defective nozzles) appearing within a contiguous block of a lines. For example, a block of twenty printed lines containing three or more lines associated with defective nozzles may introduce obvious printing artifacts. Implementations of the described method may therefore attempt to space out the lines associated with defective nozzles to reduce the apparent impact on the quality of the printed image.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method for use in printing an image in a multipass printing device, the method comprising:

obtaining information identifying two or more defective nozzles in a nozzle array;

determining that a line of a printed image is associated with more than a first predetermined number of defective nozzles based on the obtained information identifying two or more defective nozzles and selected step sizes; and identifying adjusted step sizes such that no more than the first predetermined number of defective nozzles is associated with any line of the printed image.

2. The method of claim 1, wherein the first predetermined number of defective nozzles is one.

3. The method of claim 1, wherein the first predetermined number is greater than one.

4. The method of claim 1, further comprising:

determining that a second predetermined number of adjacent lines of the printed image are each associated with one or more defective nozzles; and wherein identifying adjusted step sizes further comprises identifying adjusted step sizes such that no more than the second predetermined number of adjacent lines are associated with defective nozzles.

5. The method of claim 4, wherein the second predetermined number is one.

6. The method of claim 4, wherein the second predetermined number is greater than one.

7. The method of claim 1, further comprising:

determining that a plurality of lines associated with one or more defective nozzles are distributed in the printed image with a regular frequency; and wherein identifying adjusted step sizes further comprises identifying adjusted step sizes that avoid the distribution of the plurality of lines associated with one or more defective nozzles at a regular frequency.

8. The method of claim 1, further comprising:

determining that greater than a third predetermined number of lines associated with one or more defective nozzles are present within a block of contiguous lines of the printed image; and wherein identifying adjusted step sizes further comprises identifying adjusted step sizes such that no more than the third predetermined number of lines associated with one or more defective nozzles are present within the block of contiguous lines of the printed image.

9. An apparatus for printing an image using a plurality of passes over a print medium, the apparatus comprising:

a print head comprising an array of nozzles;

a print medium advance mechanism operable to advance a print medium past the printhead;

a controller coupled to the print medium advance mechanism and operable to:

obtain information identifying two or more defective nozzles in a nozzle array;

determine that a line of the printed image is associated with more than a first predetermined number of defective nozzles based on the obtained information identifying two or more defective nozzles and selected step sizes;

identify adjusted step sizes such that no more than the first predetermined number of defective nozzles is associated with any line of the printed image; and control the print medium advance mechanism to advance the print medium past the print head between passes of the print head based on the adjusted step sizes.

10. The apparatus of claim 9, wherein the controller is further configured to:

determine that a second predetermined number of adjacent lines of the printed image are each associated with one or more defective nozzles; and wherein the controller is further configured to identify the adjusted step sizes such that no more than the second predetermined number of adjacent lines are associated with defective nozzles.

11. The apparatus of claim 9, wherein the controller is further configured to:

determine that a plurality of lines associated with one or more defective nozzles are distributed in the printed image with a regular frequency; and wherein the controller is further configured to identify the adjusted step sizes that avoid the distribution of the plurality of lines associated with one or more defective nozzles at a regular frequency.

12. The apparatus of claim 9, wherein the controller is further configured to:

determine that greater than a third predetermined number of lines associated with one or more defective nozzles are present within a block of contiguous lines of the printed image; and wherein the controller is further configured to identify the adjusted step sizes such that no more than the third predetermined number of lines associated with one or more defective nozzles are present within the block of contiguous lines of the printed image.

13. A non-transitory computer program code comprising instructions that, when executed on a processor cause a printer controller to:

obtain information identifying two or more defective nozzles in a nozzle array;

determine that a line of a printed image is associated with more than a first predetermined number of defective nozzles based on the obtained information identifying two or more defective nozzles and selected step sizes; and identify adjusted step sizes such that no more than the first predetermined number of defective nozzles is associated with any line of the printed image.

14. The non-transitory computer program code of claim 13 further configured to cause the printer controller to:

determine that a second predetermined number of adjacent lines of the printed image are each associated with one or more defective nozzles; and wherein the identified adjusted step sizes are further identified such that no more than the second predetermined number of adjacent lines are associated with defective nozzles.

15. The non-transitory computer program code of claim 13 further configured to cause the printer controller to:

determine that a plurality of lines associated with one or more defective nozzles are distributed in the printed image with a regular frequency; and wherein the controller is further configured to identify the adjusted step sizes that avoid the distribution of the plurality of lines associated with one or more defective nozzles at a regular frequency.

16. The non-transitory computer program code of claim 13 further configured to cause the printer controller to:

determine that greater than a third predetermined number of lines associated with one or more defective nozzles are present within a block of contiguous lines of the printed image; and wherein the controller is further configured to identify the adjusted step sizes such that no more than the third predetermined number of lines associated with one or more defective nozzles are present within the block of contiguous lines of the printed image.

* * * * *

UNITED STATES PATENT AND TRADEMARK OFFICE

CERTIFICATE OF CORRECTION

PATENT NO. : 8,876,249 B2
APPLICATION NO. : 13/857748
DATED : November 4, 2014
INVENTOR(S) : Oren Perets et al.

It is certified that error appears in the above-identified patent and that said Letters Patent is hereby corrected as shown below:

In the Claims

In Column 6, Line 40, in Claim 9, delete "printhead" and insert -- print head --, therefor.

Signed and Sealed this
Twenty-eighth Day of March, 2017

Michelle K. Lee

Michelle K. Lee
*Director of the United States Patent and Trademark Office*